US010935931B2

(12) United States Patent
Farine et al.

(10) Patent No.: US 10,935,931 B2
(45) Date of Patent: Mar. 2, 2021

(54) METHOD FOR PRODUCTION OF A HOROLOGY ASSEMBLY, AND HOROLOGY ASSEMBLY THUS OBTAINED

(71) Applicant: ROLEX SA, Geneva (CH)

(72) Inventors: Sylvain Farine, Bevaix (CH); Philippe Vaucher, Sonceboz-Sombeval (CH); Vincent Von Niederhäusern, Alle (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/633,973

(22) Filed: Jun. 27, 2017

(65) Prior Publication Data

US 2018/0004159 A1 Jan. 4, 2018

(30) Foreign Application Priority Data

Jul. 4, 2016 (EP) ..... 16177751

(51) Int. Cl.
*G04B 1/18* (2006.01)
*G04B 1/14* (2006.01)

(52) U.S. Cl.
CPC ..... *G04B 1/18* (2013.01); *G04B 1/145* (2013.01)

(58) Field of Classification Search
CPC ..... G04B 1/145; G04B 1/18
See application file for complete search history.

(56) References Cited

U.S. PATENT DOCUMENTS 163,161 A 5/1875 Dawson
295,485 A 3/1884 Church
381,176 A * 4/1888 Sedgwick ..... G04B 1/18 368/144
1,600,255 A * 9/1926 Stewart ..... G04B 1/18 185/45
3,928,085 A * 12/1975 Yamamura ..... C22C 19/07 148/419
6,843,594 B1 * 1/2005 Moteki ..... F03G 1/02 267/272

(Continued)

FOREIGN PATENT DOCUMENTS

BE 425458 A 1/1938
CH 295430 A 12/1953

(Continued)

OTHER PUBLICATIONS

European Search Report and Written Opinion dated Jan. 13, 2017 issued in counterpart application No. EP16177751; w/ English partial translation and partial machine translation (23 pages).

(Continued)

*Primary Examiner* — Daniel P Wicklund
(74) *Attorney, Agent, or Firm* — Westerman, Hattori, Daniels & Adrian, LLP

(57) ABSTRACT

A method for production of a horology assembly of two components, includes (i) supplying a first component (2) being a spring, and including at least one element made of elastic material provided with a tongue (20); supplying a second component (3) provided with at least one cut-out or opening (31, 32); permanently assembling the two components. The two components cooperate by an obstacle to create the assembly, and in particular the tongue is accommodated in the at least one cut-out or opening (31, 32).

25 Claims, 4 Drawing Sheets

(56) References Cited

U.S. PATENT DOCUMENTS

| | | | | |
|---|---|---|---|---|
| 9,104,178 | B2 | 8/2015 | Gyger et al. | |
| 9,317,013 | B2 | 4/2016 | Kaelin et al. | |
| 9,448,533 | B2 | 9/2016 | Bertrand et al. | |
| 2002/0191493 | A1* | 12/2002 | Hara | F16F 1/024 368/140 |
| 2012/0281510 | A1 | 11/2012 | Gyger et al. | |
| 2013/0283615 | A1 | 10/2013 | Kaelin et al. | |
| 2014/0027205 | A1* | 1/2014 | Charbon | G04B 1/145 185/45 |
| 2014/0211596 | A1* | 7/2014 | Kaelin | G04B 1/145 368/142 |
| 2014/0355397 | A1* | 12/2014 | Conus | G04B 18/006 368/171 |
| 2015/0092523 | A1 | 4/2015 | Bertrand et al. | |
| 2015/0253731 | A1* | 9/2015 | Kaelin | G04B 1/145 368/142 |

FOREIGN PATENT DOCUMENTS

| | | | |
|---|---|---|---|
| CH | 343890 | A | 12/1959 |
| CH | 346163 | A | 4/1960 |
| CN | 104204965 | A | 12/2014 |
| EP | 2 390 732 | A1 | 11/2011 |
| EP | 2 674 817 | A2 | 12/2013 |
| FR | 7448 | E | 7/1907 |
| GB | 1148042 | A | 4/1969 |
| GB | 1 386 612 | A | 3/1975 |
| WO | 2011/069273 | A1 | 6/2011 |
| WO | 2013/150086 | A1 | 10/2013 |

OTHER PUBLICATIONS

Office Action dated May 29, 2020, issued in counterpart CN application No. 201710533529.3, with English machine translation. (22 pages).

* cited by examiner

METHOD FOR PRODUCTION OF A HOROLOGY ASSEMBLY, AND HOROLOGY ASSEMBLY THUS OBTAINED

This application claims priority of Swiss patent application European patent application No. EP16177751.1 filed Jul. 4, 2016, the content of which is hereby incorporated by reference herein in its entirety.

The invention relates to a horology barrel spring. The invention also relates to a horology barrel spring flange. The invention further relates to a spring device comprising a spring of this type and a flange of this type. The invention also relates to a barrel, a movement, or a horology piece comprising a spring of this type or a flange of this type or a spring device of this type. Finally, the invention relates more generally to a method for production of a horology assembly of two components and a method for production of a elastic horology component. The invention also relates generally to a horology assembly obtained according to the assembly implementation method.

Present barrel springs are commonly produced from spring alloys of the Nivaflex® type, and the flange is generally assembled by means of a welding spot. The supply of heat necessary for this step of the method modifies the properties of the material locally, and according to the nature of the material used for the barrel spring, in particular in the case when amorphous alloys are used which are highly sensitive to high temperatures, this can lead to a loss of performance of the spring.

A slipping flange (also known as slip-spring) is well known in the horology field, in order to avoid subjecting the barrel spring to excessive mechanical stress when overwinding takes place. The flange is conventionally assembled on the spring by welding or riveting.

Patent CH346163 describes a braking spring for a barrel spring comprising a boss which is designed to act as a rivet for securing on the drive spring.

Document CH343890 discloses securing of the flange on the barrel spring by means of a welding spot.

Document GB1386612 discloses a barrel spring fastener consisting of a tongue which is cut and folded, and is integral with the wall of the drum, which tongue slides in a slot provided in the outer end of the spring. This solution does not permit sliding of the outer end of the spring in the drum, and involves the risk of the spring breaking in the event of excessive winding.

The objective of the invention is to provide a method for production of a horology assembly which makes it possible to eliminate the above-described disadvantages, and to improve the assembly methods known in the prior art. In particular, the invention proposes a simple and reliable method for production of an assembly, which in particular is applicable to the assembly of a barrel spring and a flange.

A method for production of a horology assembly according to the invention is defined by point 1 below.

1. A method for production of a horology assembly of two components, comprising the following steps:
   - supply of a first component (2; 2') being a spring, and comprising at least one element made of elastic material, in particular of amorphous metal material or an alloy based on CoNiCr, or an electro-formed alloy based on nickel, provided with a tongue (20; 20');
   - supply of a second component (3; 9) provided with at least one cut-out or opening (31, 32);
   - permanent assembly of the two components, wherein the two components cooperate by means of an obstacle such as to create the assembly, and in particular the tongue is accommodated in the at least one cut-out or opening (31, 32).

Different embodiments of the production method are defined by points 2 to 10 below.

2. The method as defined in the preceding point, wherein the horology assembly does not comprise other connection elements of the riveting, gluing or welding type.
3. The method as defined in either of the preceding points, wherein the step of supplying the first component comprises:
   - a step of routing the first component in a strip (19) of elastic material, or a step of electro-forming the first component; and
   - a step of cutting the tongue (20) in the first component.
4. The method as defined in one of the preceding points, wherein the cutting step comprises laser cutting, in particular femtosecond laser cutting, and/or cutting by electro-erosion, in particular by electro-erosion wire, and/or cutting by machining, and/or cutting by stamping.
5. The method as defined in one of the preceding points, wherein the step of supplying the first component comprises:
   - a step of electro-forming of the first component incorporating the creation of the tongue (20) in the first component.
6. The method as defined in one of the preceding points, wherein it comprises a step of forming and securing of the element made of elastic material.
7. The method as defined in one of the preceding points, wherein the step of assembly of the two components comprises the following steps:
   - mechanical action on the tongue in order to deform the tongue elastically;
   - putting the tongue into the at least one cut-out, in particular by inserting it;
   - end of the mechanical action on the tongue.
8. The method as defined in the preceding point, wherein, before the step of mechanical action, it comprises implementation of elastic deformation of the at least one element made of elastic material in the vicinity of the tongue, without deformation of the tongue, in particular extension of the at least one element made of elastic material between two studs, in order to make the tongue come out.
9. The method as defined in the preceding point, wherein the implementation of the elastic deformation of the at least one element made of elastic material is maintained until after the end of the mechanical action on the tongue.
10. The method as defined in points 8 or 9, wherein the implementation of the elastic deformation of the at least one element made of elastic material is carried out during an operation of coiling of the spring, in particular at the end of the coiling operation.

A spring according to the invention is defined by point 11 below.

11. A barrel spring (2; 2'), in particular a barrel spring made of amorphous alloy, wherein it comprises a first configuration:
    - in the form of a tongue (20) which is designed to cooperate with at least one cut-out or opening (31, 32) in a flange (3), in order to assemble the spring and the flange, in particular to assemble them by means of an obstacle; or in the form of at least one cut-out designed to cooperate with a tongue on a flange, in order to assemble the spring and the flange, in particular to assemble them by means of an obstacle.

A flange according to the invention is defined by point 12 below.

12. A barrel spring flange (3), in particular a flange made of amorphous alloy and/or a slip-spring, with a second configuration:
   in the form of at least one cut-out or opening (31, 32), which is designed to cooperate with a tongue (20) on a spring (2), in order to assemble the spring and the flange, in particular by means of an obstacle; or
   in the form of a tongue, which is designed to cooperate with at least one cut-out in the spring, in order to assemble the spring and the flange, in particular by means of an obstacle.

A spring device according to the invention is defined by point 13 below.

13. An assembled barrel spring device (1) comprising:
   a barrel spring (2), in particular a spring according to point 11;
   a flange (3), in particular a flange according to point 12;
   a first configuration (20) on the spring; and
   a second configuration (30) on the flange,
   the first configuration and the second configuration being arranged such as to cooperate in order to assemble the spring and the flange, in particular to assemble them by means of an obstacle.

Different embodiments of the spring device are defined in points 14 and 15 below.

14. The device as defined in point 13, wherein:
   the first configuration comprises a tongue (20), and the second configuration comprises at least one cut-out or opening (31), and preferably two cut-outs or openings (31, 32); or
   the first configuration comprises at least one cut-out, and preferably two cut-outs, and the second configuration comprises a tongue.

15. The device as defined in point 14, wherein the tongue comprises a rounded free end (21), and/or the tongue comprises flanks (22, 23) which are parallel or substantially parallel, or form an angle ($\alpha$) of between 0° and 40°, and preferably between 1° and 20°, preferably between 2° and 5°, and/or the length (Lo) of the tongue is between 1 mm and 3 mm, preferably between 1 mm and 2 mm, or between 0.5 times and 2 times the width of the spring, preferably between 0.6 times and 1 times the width of the spring, and/or the width (La) of the tongue or the at least one cut-out is between 0.2 mm and 1.2 mm, preferably between 0.3 mm and 1.8 mm, or between 0.1 times and 0.8 times the width of the spring, preferably between 0.2 times and 0.5 times the width of the spring.

A barrel according to the invention is defined by point 16 below.

16. A barrel (100; 100') comprising a device (1) as defined in one of points 11 to 15.

A horology movement and piece according to the invention are defined by point 17 below.

17. A horology piece (300; 300') or horology movement (200; 200'), in particular an automatic movement, comprising a barrel (100; 100') as defined in the preceding point, or a device (1) as defined in one of points 11 to 15.

A method for production of a horology component according to the invention is defined by point 18 below.

18. A method for production of a elastic horology component, in particular a strip (2; 2') or a flange (3) of a barrel spring, comprising the following steps:
   supply of a strip (19) of amorphous material;
   cutting the component from the strip,
   wherein the cutting is carried out by means of a femtosecond laser.

The appended figures represent by way of example a plurality of embodiments of a horology piece which incorporates embodiments of a barrel spring device according to the invention.

Figure 1:
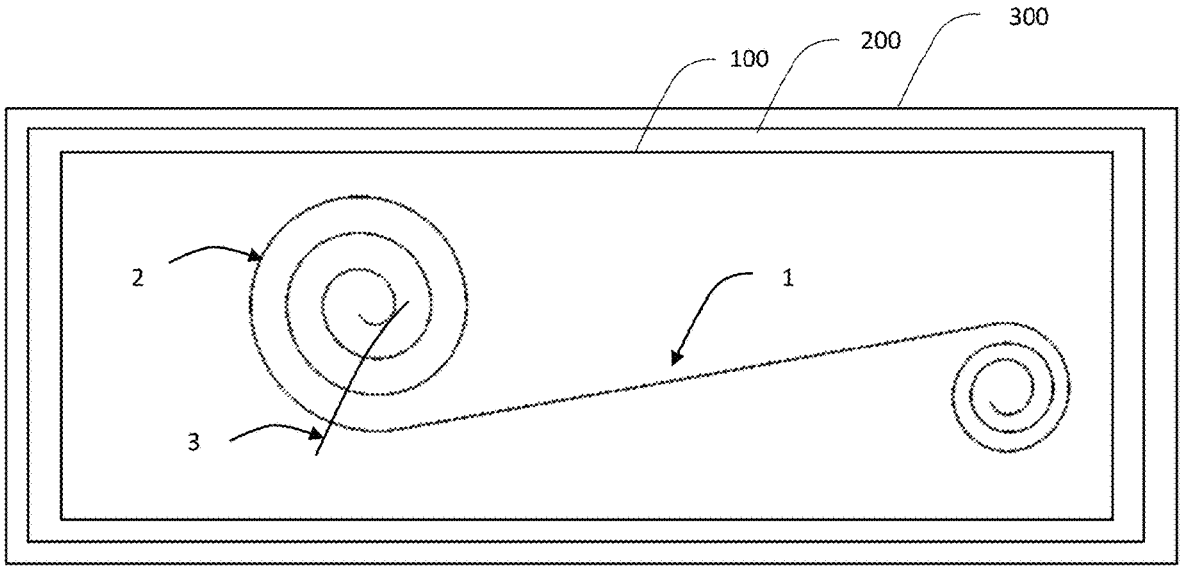
FIG. 1 is a view of a first embodiment of a horology piece according to the invention comprising a first embodiment of a horology assembly obtained according to the assembly method in accordance with the invention, in this case a barrel spring device.

A first embodiment of a horology piece 300 is described hereinafter with reference to FIGS. 1 to 10. The horology piece is for example a watch, in particular a wristwatch. The horology piece comprises a horology movement 200, in particular a mechanical movement.

The movement can be automatic or with manual winding. The movement comprises a barrel 100.

The barrel for its part comprises an assembled barrel spring 1.

The assembled barrel spring device 1 comprises:
   a barrel spring 2;
   a flange 3;
   a first configuration 20 on the spring; and
   a second configuration 30 on the flange,
   the first configuration and the second configuration being designed to cooperate in order to assemble the spring and the flange, in particular to assemble them by means of an obstacle.

The barrel spring-flange assembly is advantageously produced without another, third connection element, in order to connect the barrel spring and the flange, in particular without welding, brazing, riveting or gluing.

Assembly of a barrel spring on a flange is not possible by means of the conventional welding techniques if at least one of the components is made of amorphous alloy. The supply of heat which is necessary in order to form the connection between the two elements (spring and flange) detracts from the mechanical properties of the amorphous metal part, which becomes fragile and subsequently breaks when the spring is subjected to mechanical stresses.

Riveting is not optimal, and is therefore suitable only for small production series. In fact, the required precision of assembly is particularly problematic to control. In addition, the head of the rivet involves dimensions which are detrimental to maintaining the power reserve.

The solution of gluing the spring and the flange is not suitable, since it is not possible to achieve the adhesion necessary to withstand the winding operation, or to guarantee the required reliability during operation, in winding-letting down cycles and during sliding of the spring on the wall of the barrel drum. In addition, most high-strength glues require hardening by heat, which is difficult to implement and detrimental for amorphous metal alloy components.

In the first embodiment, the first configuration comprises a tongue 20, and the second configuration 30 comprises at least one cut-out or opening 31, and preferably two cut-outs or openings 31, 32. The use of two cut-outs or openings 31 and 32 is particularly advantageous. In fact, it makes it possible to provide an accurate and reliable assembly. This can be ensured since the tongue is accommodated in the two cut-outs as described hereinafter.

The tongue can comprise a rounded free end 21. Alternatively or in addition, the tongue can comprise flanks 22, 23 which are parallel or substantially parallel, or form an angle $\alpha$ of between 0° and 40°, and preferably between 1° and 20°, or between 2° and 5°. Preferably, the two flanks of the tongue are not parallel, in order to facilitate the assembly, and to maintain the assembly on the transverse axis as well as possible. The tongue can have a form which is globally rectangular or trapezoidal, optionally with a rounded free end.

The length Lo of the tongue can be between 1 mm and 3 mm, preferably between 1 mm and 2 mm, or between 0.5 times and 2 times the width La of the spring, preferably between 0.6 times and 1 times the width of the spring.

The width La of the tongue can be between 0.2 mm and 1.2 mm, preferably between 0.3 mm and 0.8 mm, or between 0.1 times and 0.8 times the width of the spring, preferably between 0.2 times and 0.5 times the width of the spring.

The ratio of the length Lo of the tongue to the width La of the tongue can be between 2 and 5, and preferably between 2.5 and 4.

Figure 2:
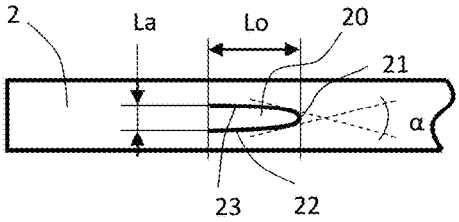
FIG. 2 is a detailed view of the functional part of a first variant of a strip or spring of the first embodiment of the barrel spring device.
Figure 3:
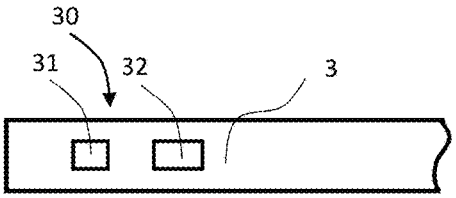
FIG. 3 is a detailed view of the functional part of a flange of the first embodiment of the barrel spring device.
Figure 4:
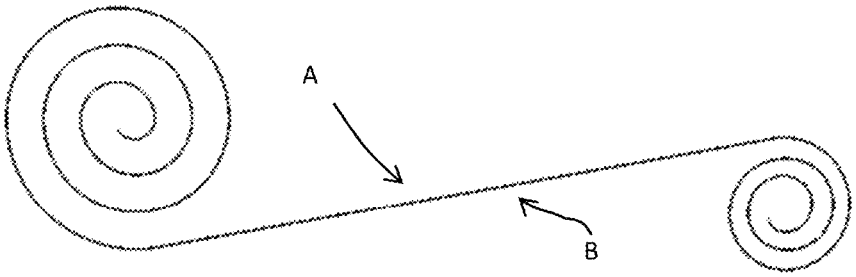
FIG. 4 is a view of a strip or of the barrel spring of the first embodiment of the barrel spring device, the strip being represented in a configuration after being secured.
Figure 5:
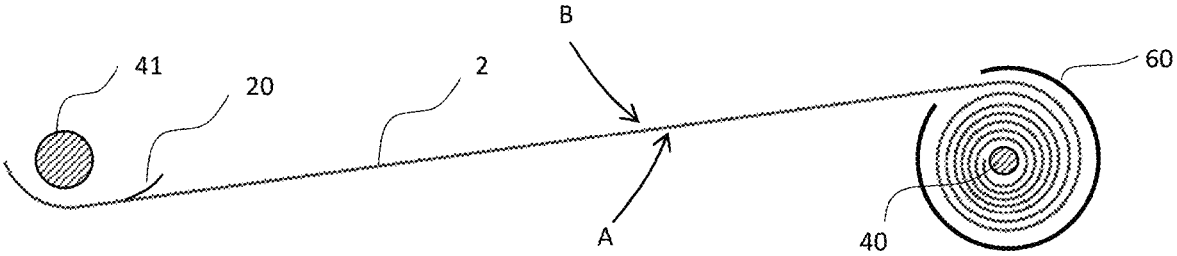
FIG. 5 is a view of the first embodiment of the barrel spring device in the process of being wound.

A first variant embodiment of the tongue is represented in FIG. 2. The tongue has globally an elongate form. Preferably, its free end is rounded.

Figure 9:
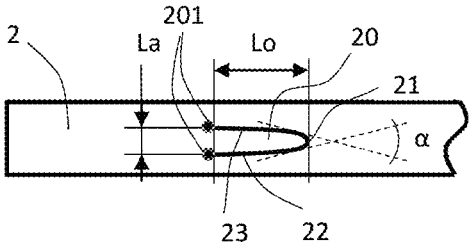
FIG. 9 is a detailed view of the functional part of a second variant of the strip or spring of the first embodiment of the barrel spring device.

A second variant embodiment of the tongue is represented in FIG. 9. It differs from the first variant in that, at the ends of the cut-out which delimit the tongues, holes 201 are provided. These holes are designed to limit the areas of concentration of stress at the ends of the cut-out, and thus prevent incipient ruptures of the material.

Figure 10:
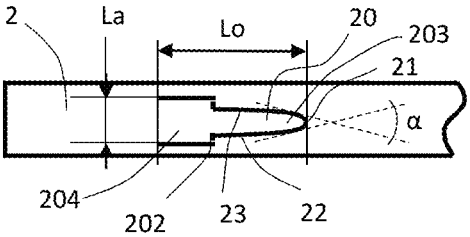
FIG. 10 is a detailed view of the functional part of a third variant of the strip or spring of the first embodiment of the barrel spring device.

A third variant embodiment of the tongue is represented in FIG. 10. This differs from the first variant in that the width La of the tongue varies, forming a shoulder 202. This shoulder is for example situated substantially in the middle of the tongue, and makes it possible to dissociate the functions of obstacle and deformation of the tongue. In fact, only the part 203 with a narrow width will cooperate with at least one of the cut-outs of the flange by penetrating into it. The other part 204 of the tongue will permit greater deformation of the tongue, in order to facilitate its introduction into the flange, whilst limiting the concentration of the stresses at the bending point situated at the end of the cut-out.

In a fourth variant embodiment of the tongue (not represented), the characteristics of the second and third variants are combined.

It will be appreciated that any other geometry of tongue which is designed to limit the concentrations of stress can be used, and the above-described examples are non-limiting.

The barrel spring 2 is preferably made of an amorphous alloy, or an alloy based on CoNiCr, or an electro-formed alloy based on nickel. As previously seen, the barrel spring comprises a first configuration in the form of a tongue 20 which is designed to cooperate with at least one cut-out 30 in the flange 3, in order to assemble the spring and the flange, in particular by means of an obstacle.

The flange 3 of the barrel spring is preferably made of an amorphous alloy. As previously seen, the flange has a second configuration 30 in the form of at least one cut-out 31, 32, which is designed to cooperate with the tongue 20 on the spring 2, in order to assemble the spring and the flange, in particular by means of an obstacle.

According to a variant of the first embodiment (not represented), the spring device is such that the first configuration comprises at least one cut-out, and preferably two cut-outs, and the second configuration comprises a tongue. The barrel spring thus comprises a first configuration in the form of at least one cut-out which is designed to cooperate with a tongue on the flange, in order to assemble the spring and the flange, in particular by means of an obstacle, and the flange thus has a second configuration in the form of a tongue which is designed to cooperate with at least one cut-out in the spring, in order to assemble the spring and the flange, in particular by means of an obstacle. Preferably, with this variant of the first embodiment, a groove is provided in the barrel drum, such as to avoid friction of the tongue (formed on the flange) against the drum, and wear of this tongue, which extends to the exterior of the spring device.

Figure 11:
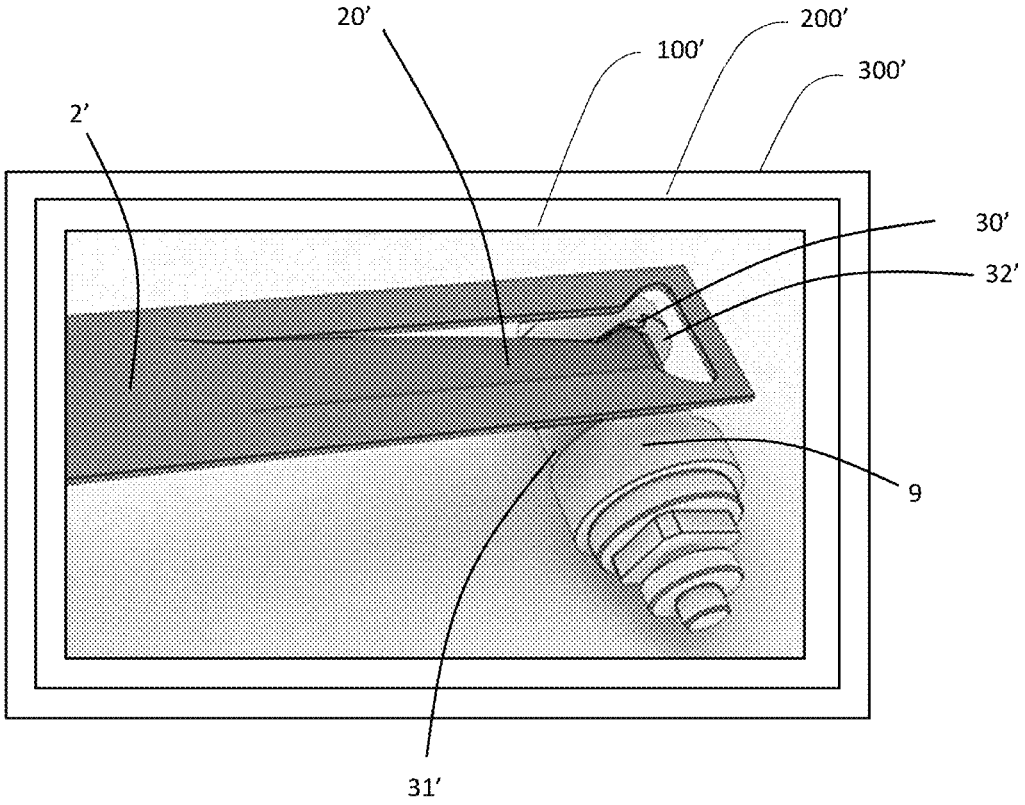
FIG. 11 is a view of a second embodiment of a horology piece according to the invention comprising a second embodiment of a horology assembly obtained according to the assembly method in accordance with the invention.

A second embodiment of a horology piece 300' is described hereinafter with reference to FIG. 11. The horology piece is for example a watch, in particular a wristwatch. The horology piece comprises a horology movement 200', in particular a mechanical movement. The movement can be automatic or with manual winding. The movement comprises a barrel 100'.

For its part, the barrel comprises a barrel spring 2' which is assembled on a barrel shaft 9. The barrel comprises a first configuration 20' on the spring and a second configuration 30' on the shaft.

The first configuration and the second configuration are designed to cooperate, in order to assemble the spring and the shaft, in particular by means of an obstacle.

The barrel spring-shaft assembly is advantageously produced without another, third connection element, in order to connect the barrel spring and the shaft, in particular without welding, brazing, riveting or gluing.

In the second embodiment, the first configuration comprises a tongue 20' and the second configuration comprises a cut-out 30'. The tongue has for example an end portion of the tongue with a substantially trapezoidal form, which is designed to cooperate with openings with a complementary form provided in a channel 31' in the core of the barrel shaft. The openings are for example hollowed in the flanks 32' of the channel 31'.

The barrel spring 2' is preferably made of an amorphous alloy, or an alloy based on CoNiCr, or of an electro-formed alloy based on nickel.

An embodiment of a method for production of a horology assembly with two components according to the invention is described hereinafter taking into consideration the spring 2 and the flange 3 previously described respectively as the first and second components.

The method comprises the following steps:

- supply of the spring 2 comprising at least one element made of elastic material, in particular an element made of elastic metal material provided with the tongue, in this case the spring being entirely formed of elastic material;
- supply of the flange provided with at least one cut-out, and in this case two cut-outs 31, 32;
- permanent assembly of the spring and the flange.

The assembly is carried out by cooperation by means of an obstacle of the spring and the flange, in particular of the tongue and the two cut-outs. In particular, the assembly is created by the fact that the tongue is accommodated in the cut-outs.

The term "permanent assembly" means that in operation or in normal operation of the assembly, the two components remain permanently assembled. However, this does not exclude the possibility that the assembly can be dismantled without deterioration of, or damage to, the two components.

Advantageously, the horology assembly does not comprise other elements for connection of the two components, and in particular no rivets, glue, welding or brazing.

Figure 6:
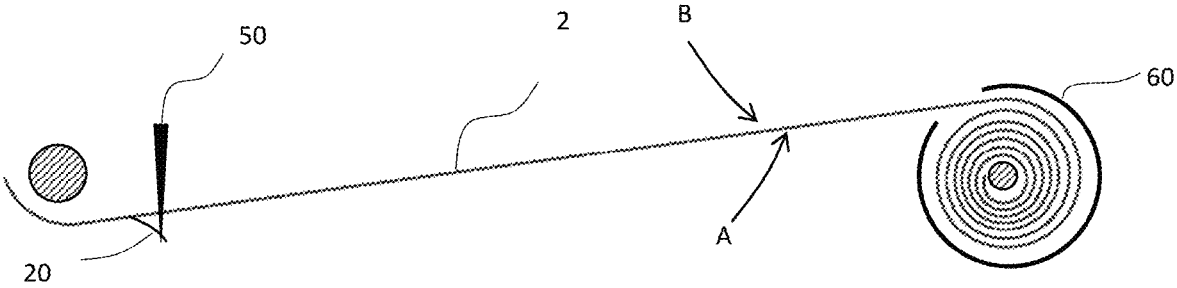
FIG. 6 is a view of the first embodiment of the barrel spring device in the process of being wound, with an operator or actuator acting on a tongue of the spring device.
Figure 7:
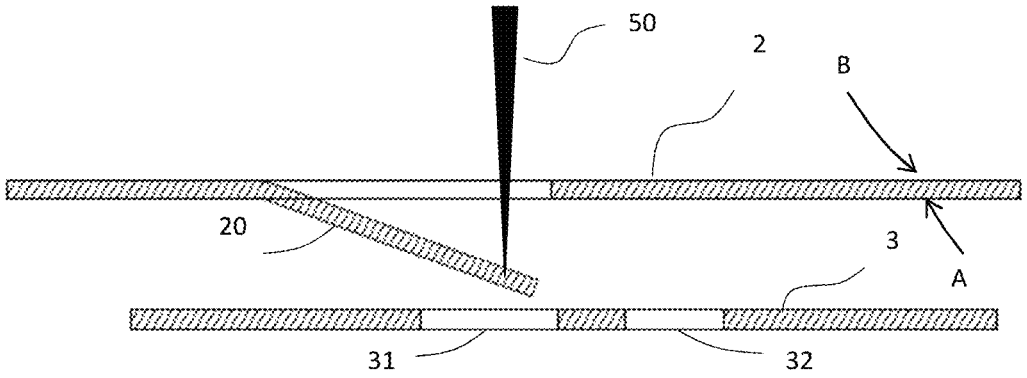
FIG. 7 is a detailed view of FIG. 6 at the tongue, with part of a flange also being represented.
Figure 8:
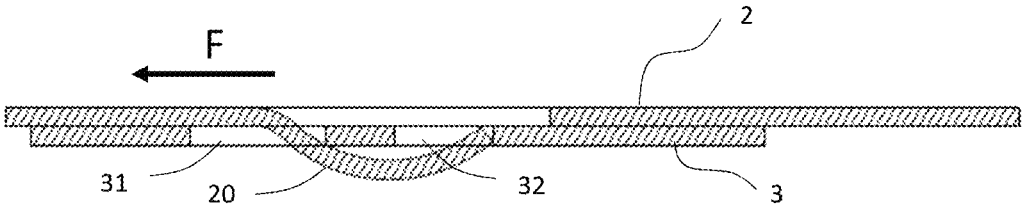
FIG. 8 is a detailed view of FIG. 1 at the spring-flange assembly.

The step of assembly of the two components comprises the following steps:

- mechanical action is exerted on the tongue, in order to deform the tongue elastically as represented in FIGS. 6 and 7. This mechanical action is exerted for example by a horologist by means of a tool 50;
- then, the tongue 20 is put into place, in particular it is inserted in the cut-out 31 as represented in FIG. 7, by bringing the spring and the tongue towards one another whilst maintaining the mechanical action on the tongue;
- then, the mechanical action on the tongue is eliminated, and the tongue tends to adopt once more its form and position of rest, by curving such that its free end is accommodated in the cut-out 32, as represented in FIG. 8.

The spring and the flange are thus assembled to one another. The assembly continues to be detachable in the event of a service operation, by exerting a force of displacement of the spring relative to the flange in the sense and direction of the arrow F represented in FIG. 8. It is thus possible to change the spring or the flange of a barrel easily.

Advantageously, before the step of mechanical action, there is implementation of elastic deformation of the at least one element made of elastic material in the vicinity of the tongue, without deformation of the tongue, in particular extension of the at least one element made of elastic material between two studs 40, 41, in order to make the tongue come out onto a face B of the spring. This step is represented for example in FIG. 5. One of the studs 40 is rotated in order to wind the spring in an open ring 60. As a result of the deformation in the vicinity of the tongue (without deformation of the tongue, which remains in its state of rest), the tongue has a form, and in particular a curvature, which is different from that of its vicinity. This makes it possible to make the tongue apparent on the spring. Preferably, the elastic deformation of the at least one element made of elastic material in the vicinity of the tongue is maintained at least for as long as the tongue is deformed by mechanical action, i.e. until at least after the end of the exertion of the mechanical action on the tongue. Thus, as a result of the pre-compression which provides the spring with its free form, when the part of the spring comprising the tongue is deformed in order to be in a straight configuration, the tongue is subjected to tension, is released, and points freely on the face B of the spring, opposite the face A against which the flange will be brought.

In order to exert the mechanical action on the tongue, so as to deform the tongue elastically as represented in FIGS. 6 and 7, the horologist thrusts the tongue, in particular by means of a tool 50, in order to make it go beyond the face A of the spring.

Thus, the flange can be presented to the tongue. In order to put the tongue 20 in place in the cut-out 31, the horologist can in fact bring the flange against the spring, by inserting or sliding the tongue into the cut-out 31.

As a result of the stresses in the tongue, when the tongue is released it is placed against the flange in order to block it. Advantageously, the end of the tongue is then placed in the cut-out 32 in the flange, as represented in FIG. 8.

Preferably, the implementation of the elastic deformation of the at least one element made of elastic material is carried out during an operation of coiling of the spring, in particular at the end of the coiling operation.

As a consequence of what has previously been described, the flange is assembled during the coiling operation, aimed at winding the pre-compressed spring in the open ring 60, with the winding of the spring beginning with the inner end (eye) and ending at the outer end with the tongue.

Another embodiment of a method for production of a horology assembly of two components according to the invention is described hereinafter, taking into consideration the spring 2' and the barrel shaft 30' previously described respectively as the first and second components.

The method comprises the following steps:

- supply of the spring 2' comprising at least one element made of elastic material provided with the tongue, in this case the spring being entirely formed of elastic material;
- supply of the barrel 9 provided with at least one cut-out, and in this case two cut-outs 32';
- permanent assembly of the spring and the barrel shaft.

The assembly is carried out by cooperation by means of an obstacle of the spring and the barrel shaft, in particular of the tongue and the two cut-outs. In particular, the assembly is created by the fact that the tongue is accommodated in the cut-outs.

An embodiment of a method for production of a spring 2 or 2', in particular a spring used in the method for production of a horology assembly previously referred to, is described hereinafter.

Figure 12:
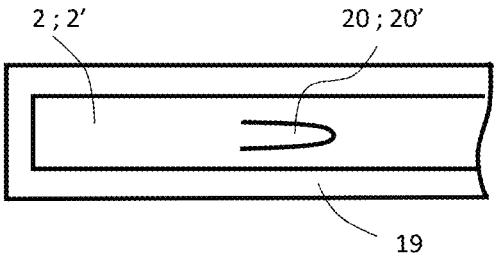
FIG. 12 is a view illustrating a method for production of a spring by cutting into a strip of material.

The method for production of the spring comprises:

- a step of routing of the spring 2; 2' in a strip of elastic material 19 as represented in FIG. 12, or a step of electro-forming of the spring; and
- a step of cutting the tongue 20; 20' in the spring.

Advantageously, the cutting step comprises laser cutting, in particular femtosecond laser cutting, and/or cutting by electro-erosion, in particular by electro-erosion wire, and/or cutting by machining, and/or cutting by stamping. In view of the dimensions and the need to maintain the mechanical properties of the alloy used, precedence is given to the solution of femtosecond laser cutting. However the other techniques can still be envisaged. Laser cutting, in particular femtosecond laser cutting, has the following advantages:

- it makes possible a precise cut, without detracting from the mechanical properties of the spring;
- it provides great freedom of geometry of cutting, and therefore in the design of the cutting, particularly of rounded parts at the beginning of cutting of the tongue;
- it is implemented by an industrial method which eliminates wear, which occurs in the case of a cutting tool.

Advantageously, when the method for production of the spring comprises a step of electro-forming of the spring, this step incorporates the creation of the tongue in the spring.

Also advantageously, the method for production of the spring comprises a step of forming and fixing of the element made of elastic material. The fixing step is important in order to obtain good functioning of the spring, irrespective of the material used. For an amorphous alloy, an example of a fixing method is described in application WO2011069273. For elements made of spring alloy such as Nivaflex®, the fixing can be carried out in a conventional manner, by means of heat in a furnace under vacuum.

Preferably, the method for production of the spring previously described is implemented in the step of the supply of the spring comprising at least one element made of elastic material provided with the tongue according to the method for production of a horology assembly previously described.

An embodiment of a method for production of a elastic horology component, in particular a strip or spring flange of a barrel, is described hereinafter.

The method comprises the following steps:

- supply of a strip of amorphous material;
- cutting of the component from the strip, the cutting being carried out by means of a femtosecond laser.

A method of this type makes it possible to carry out the precise cutting of the tongue before forming of the spring, for example by using the method described in application WO2011/069273. Thus, it is then possible to have a pre-compressed tongue which will be released from the spring during the coiling step as previously described with reference to FIG. 5.

Thus, the invention makes it possible to form in the barrel spring a tongue which is designed to be used as a tang which will be accommodated in cut-outs provided in the flange, during the step of coiling of the barrel spring. This makes it possible to couple the flange on the spring in a non-permanent manner (i.e. the assembly can be undone), and without detracting from the mechanical properties of the materials of the spring and the flange, and more generally without detracting from the mechanical properties of the materials of the two assembled horology components.

For as long as the spring and the flange are retained in a ring or in the drum, the assembly is very strong. The fact that the two parts are assembled freely with slight play, i.e. without the stresses involved in welding or riveting, results in a decrease in the internal stresses in the two components. This is beneficial for the properties of the final assembled component.

Unlike the solution of assembly of the flange and the spring by welding, when the spring device is extracted from the barrel, the invention makes it possible to separate the flange from the spring. In addition, as previously seen, the assembly is carried out without heating, and with reduction of the internal stresses on the assembly. In fact, in order to carry out a weld, it is necessary to place the two parts well against one another before carrying out the welding, and this can give rise to local stresses which can be substantial.

Thus, according to the invention, it is possible to assemble the barrel spring on a flange mechanically, without resorting to thermal means (welding or brazing), or to an assembly part (rivet). The link between the two components is carried out reversibly and elastically, and without affecting the properties of the assembled components.

Throughout this document, "tongue" means any part of a strip of material which is delimited by a curve opened by cutting the strip according to the thickness of the strip, and by a segment which connects the two ends of the open curve. Advantageously, the tongue is completely surrounded by material which forms the remainder of the strip. Thus, the tongue is formed by cutting the spring or the flange without discarded material (other than the material which is on the cutting curve). In other words, the width of the spring 2 or of the flange at the tongue is not reduced to the width of the tongue, but is greater than the width of the tongue. For example, a width of the spring does not change throughout a length of the tongue, as shown in the embodiments of the Figures. In fact, material which forms the spring or the flange is present on both sides of the tongue, relative to the longitudinal direction of the spring or of the flange. In addition, the tongue does not form the end of the spring or of the flange.

Throughout this document, "barrel spring device" or "assembled barrel spring" means an assembly comprising a barrel spring and a flange. The barrel can form part of a gear train chain, or can be incorporated for example in an additional module such as a striking work. In addition, throughout this document, when the spring is made of amorphous alloy, "spring" or "barrel spring" means a spring strip which has been subjected to a securing process.

In this document, the term "flange" encompasses the following meanings:

- "slip-spring" or "slipping spring", i.e. an element fixed to the mainspring at the outer end of the mainspring. The element presses against the walls of the barrel drum and forms slightly more than one complete coil. The element allows the mainspring to wind normally and then slips against the walls of the drum. The mainspring is thus not hooked to the barrel; and
- "mainspring-bridle", i.e. an element, the essential function of which is, in a barrel, to hold the outer end of a mainspring against the walls of the barrel when the mainspring uncoils. The element causes the mainspring to wind and unwind more concentrically round its arbor. The element may be a short flexible blade fixed to the end of the mainspring. The element engages in the barrel to be hold in position and at the same time to hold the mainspring against the walls of the barrel.

The invention claimed is:

1. A method for production of a horology assembly of a first component and a second component, one of the first and second components being a spring and the other of the first and second components being a flange, the method comprising:

- supplying the first component comprising at least one element made of elastic material, provided with a tongue, wherein portions of the first component extend along the tongue and past an end of the tongue so that the first component is present on both sides of the tongue and past the end of the tongue;
- supplying the second component provided with at least one cut-out or opening;
- permanently assembling the first and second components, wherein the first and second components cooperate so as to create the assembly, wherein the tongue is accommodated in the at least one cut-out or opening so as to form an obstacle between the spring and the flange;

wherein the assembling of the first and second components comprises:

performing a mechanical action on the tongue in order to deform the tongue elastically;

putting the tongue into the at least one cut-out;

ending the mechanical action on the tongue, and further comprising, before the performing of the mechanical action, implementing elastic deformation of the at least one element made of elastic material in a vicinity of the tongue, without deformation of the tongue, in order to make the tongue come out.

2. The method as claimed in claim 1, wherein the horology assembly does not comprise other connection elements of the riveting, gluing or welding type.

3. The method as claimed in claim 1, wherein the supplying of the first component comprises:

routing the first component in a strip of elastic material, or electro-forming the first component; and cutting the tongue in the first component.

4. The method as claimed in claim 1, wherein the cutting comprises at least one selected from the group consisting of laser cutting, cutting by electro-erosion, cutting by machining, and cutting by stamping.

5. The method as claimed in claim 1, wherein the supplying of the first component comprises:

electro-forming the first component incorporating the creation of the tongue in the first component.

6. The method as claimed in claim 1, which comprises forming and securing the element made of elastic material.

7. The method as claimed in claim 1, wherein the implementation of the elastic deformation of the at least one element made of elastic material is maintained until after the end of the mechanical action on the tongue.

8. The method as claimed in claim 1, wherein the implementation of the elastic deformation of the at least one element made of elastic material is carried out during an operation of coiling of the spring.

9. An assembled barrel spring device produced by the method of claim 1.

10. The device as claimed in claim 9, wherein at least one selected from the group consisting of:

(1) the tongue comprises at least one selected from the group consisting of (i) a rounded free end, (ii) flanks which are parallel or substantially parallel, and (iii) flanks that form an angle of between 0° and 40°, a length between 1 mm and 3 mm, or a length between 0.5 times and 2 times the width of the spring, and (2) a width of at least one selected from the group consisting of the tongue and the at least one cut-out is at least one selected from the group consisting of (i) in a range of from 0.2 mm to 1.2 mm, and (ii) in a range of from 0.1 times to 0.8 times the width of the spring.

11. A barrel comprising a device produced by the method of claim 1.

12. A horology piece or horology movement, comprising the barrel as claimed in claim 11.

13. The method of claim 1, further comprising:

supplying a strip of amorphous material;

cutting a component from the strip, wherein the cutting is carried out using a femtosecond laser, wherein the component is the spring.

14. The method according to claim 1, wherein the at least one element made of elastic material is made of an amorphous metal material or an alloy based on CoNiCr, or an electro-formed alloy based on nickel.

15. The method as claimed in claim 1, wherein the elastic deformation of the at least one element is implemented by extending the at least one element made of elastic material between two studs.

16. The method as claimed in claim 1, wherein the spring is a barrel spring and the flange is a slipping flange.

17. The method of claim 1, further comprising:

supplying a strip of amorphous material;

cutting a component from the strip, wherein the cutting is carried out using a femtosecond laser, wherein the component is the flange.

18. The method according to claim 1, wherein a width of the first component is not reduced throughout the portions of the first component that extends along the tongue and past the end of the tongue.

19. The method according to claim 18, wherein a width of the first component does not change throughout a length of the tongue.

20. The method according to claim 1, wherein the tongue is obtained by cutting a shape of the tongue in the first component without discarded material other than material on a cutting curve.

21. The method according to claim 1, wherein the spring and the flange are in contact in an area of the portions of the first component extending along the tongue and past an end of the tongue.

22. A method for production of a horology assembly of a first component and a second component, one of the first and second components being a spring and the other of the first and second components being a flange, the method comprising:

supplying the first component comprising at least one element made of elastic material, provided with a tongue;

supplying the second component provided with at least one cut-out or opening;

permanently assembling the first and second components;

performing a mechanical action on the tongue in order to deform the tongue elastically;

putting the tongue into the at least one cut-out; and ending the mechanical action on the tongue, wherein before the performing of the mechanical action, implementing elastic deformation of the at least one element made of elastic material in a vicinity of the tongue, without deformation of the tongue, in order to make the tongue come out, and wherein the first and second components cooperate so as to create the assembly, wherein the tongue is accommodated in the at least one cut-out or opening so as to form an obstacle between the spring and the flange.

23. The method as claimed in claim 22, wherein the implementation of the elastic deformation of the at least one element made of elastic material is maintained until after the end of the mechanical action on the tongue.

24. The method as claimed in claim 22, wherein the first component is the spring, and the implementation of the elastic deformation of the at least one element made of elastic material is carried out during an operation of coiling of the spring.

25. The method as claimed in claim 22, wherein the elastic deformation of the at least one element is implemented by extending the at least one element made of elastic material between two studs.

* * * * *